US007381072B2

(12) United States Patent
Nagano

(10) Patent No.: US 7,381,072 B2
(45) Date of Patent: Jun. 3, 2008

(54) CONNECTOR HAVING A STRAIN RELIEF STRUCTURE

(75) Inventor: Masao Nagano, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/523,596

(22) Filed: Sep. 20, 2006

(65) Prior Publication Data

US 2007/0077798 A1 Apr. 5, 2007

(30) Foreign Application Priority Data

Sep. 30, 2005 (JP) ..... P2005-289104

(51) Int. Cl.
*H01R 13/64* (2006.01)

(52) U.S. Cl. ..... 439/248; 439/459

(58) Field of Classification Search ..... 439/247, 439/248, 459, 456, 468, 686
See application file for complete search history.

(56) References Cited

U.S. PATENT DOCUMENTS

| | | | | |
|---|---|---|---|---|
| 4,210,380 | A * | 7/1980 | Brzostek | 439/456 |
| 4,445,741 | A * | 5/1984 | Annoot | 439/290 |
| 4,580,862 | A * | 4/1986 | Johnson | 439/248 |
| 4,874,331 | A * | 10/1989 | Iverson | 439/449 |
| 5,098,312 | A * | 3/1992 | Raczynski | 439/362 |
| 5,100,335 | A * | 3/1992 | Yamamoto | 439/271 |
| 5,187,328 | A * | 2/1993 | Burgess et al. | 174/564 |
| 5,222,909 | A * | 6/1993 | Nomura et al. | 439/607 |
| 5,297,976 | A * | 3/1994 | VanDerStuyf et al. | 439/271 |
| 5,324,209 | A * | 6/1994 | Falossi et al. | 439/362 |
| 5,575,681 | A | 11/1996 | Muzslay et al. | |
| 5,586,916 | A | 12/1996 | Shinji et al. | |
| 5,616,048 | A * | 4/1997 | Myer et al. | 439/398 |
| 5,704,799 | A * | 1/1998 | Wood | 439/281 |
| 5,865,636 | A * | 2/1999 | Myer et al. | 439/275 |
| 5,895,282 | A * | 4/1999 | Little | 439/332 |
| 5,921,806 | A * | 7/1999 | Shuey | 439/464 |
| 5,954,546 | A * | 9/1999 | Fink et al. | 439/752 |
| 5,997,349 | A * | 12/1999 | Yoshioka | 439/579 |
| 6,000,955 | A * | 12/1999 | Zaderej | 439/79 |
| 6,203,348 | B1 * | 3/2001 | Fukuda | 439/275 |
| 6,257,928 | B1 * | 7/2001 | Murakami et al. | 439/587 |
| 6,478,608 | B1 * | 11/2002 | Grant et al. | 439/468 |
| 6,554,623 | B2 * | 4/2003 | Yoshioka | 439/98 |
| 6,840,795 | B1 * | 1/2005 | Takeda et al. | 439/492 |
| 2002/0013089 | A1 * | 1/2002 | Ichio et al. | 439/587 |

FOREIGN PATENT DOCUMENTS

| | | |
|---|---|---|
| EP | 0 818 855 A1 | 1/1998 |
| EP | 0 913 890 A2 | 5/1999 |
| EP | 1 227 551 A2 | 7/2002 |
| JP | 2004-273135 A | 9/2004 |

* cited by examiner

*Primary Examiner*—Tulsidas C. Patel
*Assistant Examiner*—Vladimir Imas
(74) *Attorney, Agent, or Firm*—Sughrue Mion, PLLC

(57) ABSTRACT

A connector includes a rear cover which is fixed to a rear portion of an outer housing in non-contacting relation to an inner housing. A strain relief structure, including a wire bending portion for bending and holding wires, is provided at the rear cover. The connector further includes springs. The inner housing is mounted in the outer housing such that the inner housing 11 is urged forward by the springs.

3 Claims, 3 Drawing Sheets

CONNECTOR HAVING A STRAIN RELIEF STRUCTURE

BACKGROUND OF THE INVENTION

1. Field of the Invention

This invention relates to a connector which receives and holds terminals therein, and has wires (connected to the respective terminals) led out of the connector, and more particularly to a connector having a strain relief structure by which vibration of each wire due to external vibration, an impact, a pulling force, etc., will not directly influence the terminal.

2. Related Art

There is known one conventional connector in which a cover is fixed to a female connector housing receiving terminals therein (see, for example, JP-A-2004-273135). This conventional connector will be described with reference to FIG. 3.

As shown in FIG. 3, in the connector 100, the terminals 150 are received within respective terminal receiving chambers 102 of the female connector housing 101, and wires 151 connected to the respective terminals 150 are supported by a rubber plate 104 within the cover 103, and pass through a corrugated tube 105, and are led out of the female connector housing 101. The cover 103 is fixed to a rear portion of the female connector housing 101.

In this connector 100, the terminals 150 are received within the female connector housing 101, and the cover 103 supporting the wires 151 is firmly fixed to the female connector housing 101. Therefore, when vibration develops in the wire 151, this vibration is transmitted directly to the female connector housing 101 via the cover 103, and as a result the associated terminal 150 within the female connector housing 101 is shaken, which leads to a possibility that a contact portion of this terminal held in contact with a terminal of a mating connector is worn.

And besides, the wire 151 is fixed to extend linearly within this connector 100, and therefore vibration applied to the wire 151 is liable to be directly transmitted to the terminal 150.

SUMMARY OF THE INVENTION

This invention has been made in view of the above circumstances, and an object of the invention is to provide a connector of such a construction that vibration of a wire will not be directly transmitted to an associated terminal.

The above object has been achieved by a connector having features recited in the following Paragraphs (1) to (3).

(1) A connector characterized in that the connector comprises:

an inner housing receiving a terminal therein;

an outer housing which is separate from the inner housing, and is disposed around the inner housing to cover an outer peripheral surface of the inner housing;

a rear cover which is separate from the inner housing, and is fixed to a rear portion of the outer housing in non-contacting relation to the inner housing; and a wire which is connected to the terminal, and is led out of the inner housing through a rear end thereof, and passes through the rear cover to be led out of the rear cover; and a strain relief structure which holds the wire is provided at the rear cover.

(2) The connector of the above Paragraph (1) is further characterized in that the strain relief structure is formed within the rear cover, and includes a wire bending portion which bends and holds the wire.

(3) The connector of the above Paragraph (1) or Paragraph (2) is further characterized in that the connector further comprises a resilient urging member interposed between the inner housing and the outer housing; and the inner housing is mounted in the outer housing such that the inner housing is urged forward by the resilient urging member.

In the connector of the construction of the above Paragraph (1), the rear cover, having the strain relief structure for holding the wire, is separate from the inner housing, and is fixed to the outer housing in non-contacting relation to the inner housing. Therefore, vibration of the wire will not directly influence the inner housing which receives the terminal connected to the wire.

In the connector of the construction of the above Paragraph (2), the strain relief structure is formed within the rear cover, and includes the wire bending portion which bends and holds the wire. Therefore, particularly when vibration of a small wavelength develops in the wire, this vibration is absorbed by a bent portion of the wire bent by the wire bending portion of the rear cover, and therefore is less liable to be transmitted to the terminal.

In the connector of the construction of the above Paragraph (3), the inner housing is mounted in the outer housing such that the inner housing is urged forward by the resilient urging member interposed between the inner and outer housings. Therefore, vibration, transmitted from the rear cover to the outer housing, is absorbed by the resilient urging member serving as a damper. Particularly when vibration of a large wavelength develops in the wire, the rear cover and the outer housing are shaken, thereby greatly suppressing the influence of the vibration on the inner housing.

In the present invention, there can be provided the connector of such a construction that vibration of the wire will not be directly transmitted to the terminal, and this construction can greatly reduce a possibility that a contact portion of the terminal held in contact with a terminal of a mating connector is worn because of the shaking of the terminal.

The present invention has been briefly described above. Details of the invention will become more manifest upon reading the following Section "DETAILED DESCRIPTION OF THE PREFERRED EMBODIMENT" with reference to the accompanying drawings.

DETAILED DESCRIPTION OF THE PREFERRED EMBODIMENT

A preferred embodiment of the present invention will now be described in detail with reference to the drawings.

Figure 1:
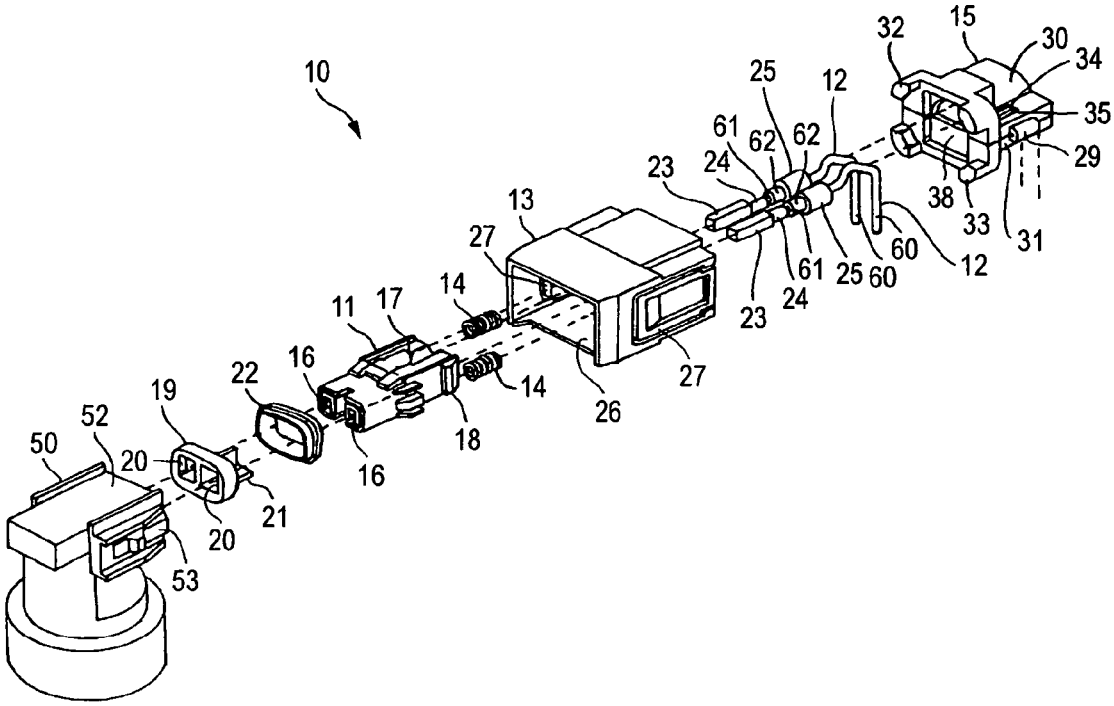
FIG. 1 is an exploded, perspective view of one preferred embodiment of a connector of the present invention.
Figure 2:
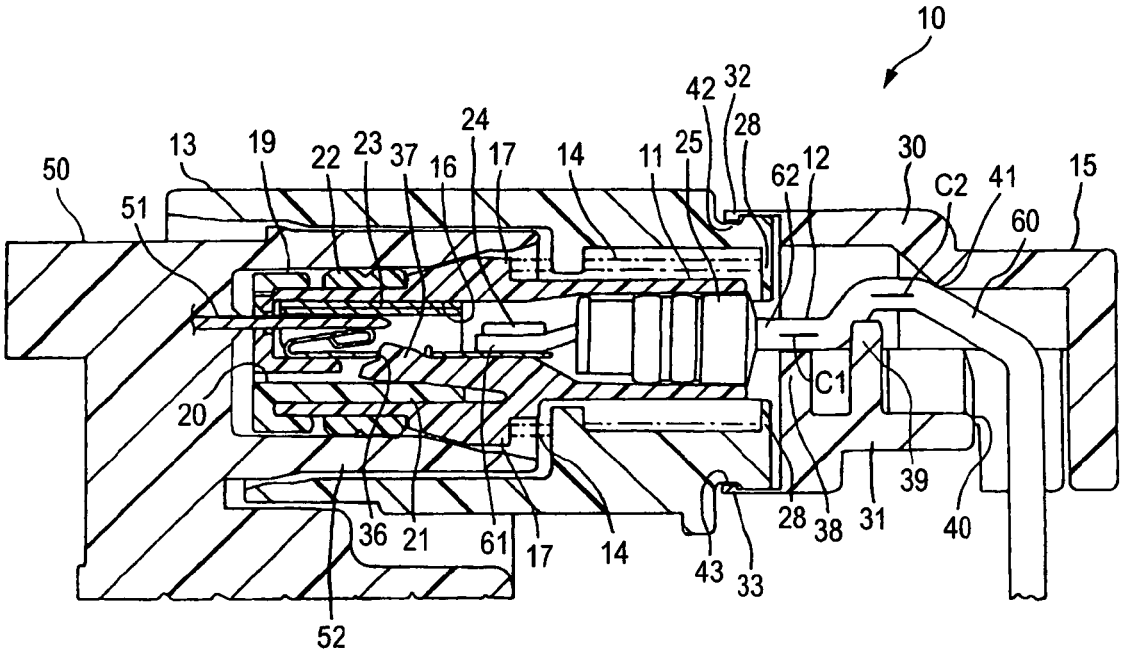
FIG. 2 is a cross-sectional view showing a condition in which the connector of FIG. 1 in its assembled condition is fitted to a mating connector.
Figure 3:
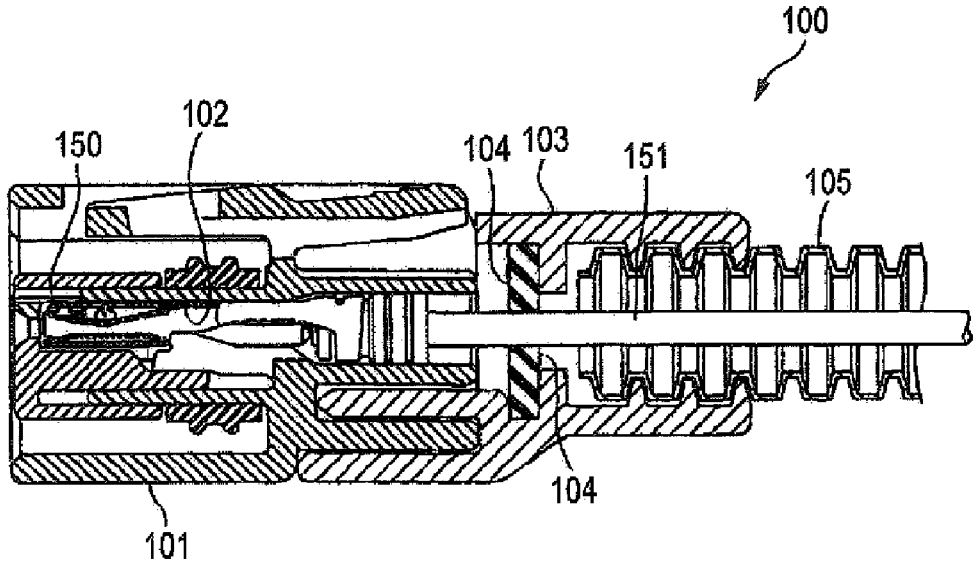
PRIOR ART FIG. 3
FIG. 3 is a cross-sectional view of a conventional connector.

FIG. 1 is an exploded, perspective view of one preferred embodiment of a connector of the invention, and FIG. 2 is a cross-sectional view showing a condition in which the connector of FIG. 1 in its assembled condition is fitted to a mating connector.

As shown in FIGS. 1 and 2, the connector 10 of this embodiment comprises an inner housing 11 for receiving terminals 23, an outer housing 13 which is separate from the inner housing 11, and is disposed around the inner housing 11 to cover an outer peripheral surface of this inner housing 11, a rear cover 15 which is separate from the inner housing 11, and is fixed to a rear portion of the outer housing 13 in non-contacting relation to the inner housing 11, and wires 60 which are connected respectively to the terminals 23, and are led out of the inner housing 11 through a rear end thereof, and passes through the rear cover 15 to be led out of this rear cover 15.

A strain relief structure for holding the wires 60 is provided at the rear cover 15. This strain relief structure is formed within the rear cover 15, and includes a wire bending portion (39 and 41) for bending and holding the wires 60.

The connector 10 further comprises springs 14 disposed between the inner housing 11 and the outer housing 13. The inner housing 11 is mounted within the outer housing 13 such that the inner housing 11 is urged forward by the springs 14.

Details of the connector 10 of this construction will be described below.

As shown in FIG. 1, the connector 10 which can be fitted to the mating connector 50 includes two terminal-equipped wires 12, and the two springs (resilient urging members) 14. The connector 10 further includes, as main constituent elements, the inner housing 11 made of a synthetic resin, the outer housing 13 made of a synthetic resin, a front holder 19 made of a synthetic resin, and a seal member 22 made of rubber.

The inner housing 11 has a pair of terminal receiving chambers 16 and 16 extending therethrough from its front end surface to its rear end surface. A pair of spring retaining projections 17 and 17 (The lower spring retaining projection is shown in FIG. 2) are formed respectively on upper and lower surfaces (forming part of the outer peripheral surface) of the inner housing 11. A pair of outer housing retaining portions (The outer housing retaining portion disposed at the rear side in FIG. 1 is not shown) 18 and 18 are formed respectively at opposite side surfaces of the inner housing 11.

The front holder 19 is inserted into the inner housing 11 from the front end of this inner housing 11. A pair of guide holes 20 and 20 for guiding the insertion of a pair of mating terminals 51 and 51 (see FIG. 2) of the mating connector 50 into the respective terminal receiving chambers 16 and 16 of the inner housing 11 are formed in a front surface of the front holder 19. The front holder 19 further includes a lance flexure limitation piece portion 21 projecting rearwardly therefrom. This lance flexure limitation piece portion 21 is inserted into the inner housing 11.

The annular seal member 22 is mounted on the inner housing 11 in surrounding relation to the outer peripheral surface of the front end portion thereof. The seal member 22 thus mounted on the inner housing 11 has the function of preventing a liquid (such as water) and dirt and dust from intruding into the inside of the inner housing 11 from the exterior of the outer housing 13 and also from the exterior of the mating connector 50.

Each of the terminal-equipped wires 12 comprises the terminal 23 formed by a pressing process including blanking, and the wire 60 to which a rear press-clamping portion 24 of the terminal 23 is press-fastened, thereby electrically connecting a conductor 61 of this wire 60 to the terminal 23. An annular seal ring 25 is snugly fitted on a sheath 62 of the wire 60, and is disposed rearwardly of the press-clamping portion 24 of the terminal 23. The terminal 23 is a so-called crimp-type (or press-clamping) terminal.

The outer housing 13 has a single inner housing insertion hole 26 of a square cross-section extending axially therethrough from its front end surface to its rear end surface, and a pair of inner housing retaining portions (not shown) are formed on an inner peripheral surface of the outer housing 13 defining the inner housing insertion hole 26. The outer housing 13 has elastic piece portions 27 and 27 (for fixing the mating connector) formed respectively at opposite side surfaces thereof. Spring retaining portions 28 and 28 (see FIG. 2) are formed on the inner peripheral surface of the outer housing 13 at the rear end thereof where a rear open end of the inner housing insertion hole 26 is disposed, the spring retaining portions 28 and 28 being disposed in opposed relation to the spring retaining projections 17 and 17 of the inner housing 11, respectively.

Each of the springs 14 is a compression coil spring. The inner housing 11 is inserted into the inner housing insertion hole 26 of the outer housing 13 from the front side thereof, with the opposite ends of each of the springs 14 and 14 retained respectively by the corresponding spring retaining projection 17 of the inner housing 11 and the corresponding spring retaining portion 28 of the outer housing 13. As a result, the outer housing retaining portions 18 and 18 of the inner housing 11 are retained respectively by the inner housing retaining portions of the outer housing 13, so that the inner housing 11 is supported within the inner housing insertion hole 26 of the outer housing 13 in a generally floating manner through the springs 14 and 14 each having a resilient force (i.e., a spring-back force) accumulated therein.

The rear cover 15 is so constructed as to be opened through a hinge 29, and this rear cover 15 comprises an upper cover 30 and a lower cover 31 which are disposed respectively at the upper and lower sides with respect to the hinge 29. Hood portions 32 and 33 for engagement with the outer peripheral surface of the rear end portion of the outer housing 13 are formed at front ends of the upper and lower covers 30 and 31, respectively. In the rear cover 15, the upper and lower covers 30 and 31 in the open condition are closed through the hinge 29, and at this time a retaining piece portion 34, formed at that side portion of the lower cover 31 opposite from the hinge 29, is snappingly fitted into an engagement hole 35 formed in a side portion of the upper cover 30, so that the rear cover 15 is assembled.

As shown in FIG. 2, the terminals 23 of the terminal-equipped wires 12 are inserted respectively into the terminal receiving chambers 16 of the inner housing 11, and are received therein. At this time, a projection of a terminal retaining piece portion 37, projecting into each terminal receiving chamber 16 of the inner housing 11, is engaged in a positioning hole 36 formed in a bottom portion of the corresponding terminal 23, thereby positioning and fixing the terminal 23.

When the front holder 19 is inserted into the front end portion of the inner housing 11, the lance flexure limitation piece portion 21 of the front holder 19 supports the terminal retaining piece portions 37 in a manner to prevent the deformation of these terminal retaining piece portions 37.

The wires 60 of the terminal-equipped wires 12 are rearwardly led out of (that is, extend rearwardly from) the inner housing 11 inserted in the inner housing insertion hole 26 of the outer housing 13. Therefore, the wires 60 of the terminal-equipped wires 12 are led out of the outer housing 13.

The lower cover 31 of the rear cover 15 includes a first plate portion 38 for holding each led-out wire 60 in a straight condition such that an axis C1 of this straight portion coincides with the axis of the portion of the wire 60 just led out of the inner housing 11, a second plate portion 39 (forming part of the wire bending portion) for bending each wire 60 into a position where its axis C2 is disposed at a level higher than the axis C1, and a lead-out hole 40 for leading the bent wires 60 to the exterior. A wire holding portion 41 (forming part of the wire bending portion) for holding the wires 60 at a position disposed rearwardly of the second plate portion 39 of the lower cover 31 is formed at the upper cover 30 opposed to the lower cover 31. Thus, the strain relief structure is formed at the rear cover 15.

For attaching the rear cover 15 to the outer housing 13, the two covers 30 and 31 are opened, and in this open condition the wires 60 led out of the inner housing 11 are placed on the lower cover 31, and then the two covers 30 and 31 are closed such that the hood portions 32 and 33 are fitted respectively in grooves (or recesses) 42 and 43 formed in the rear end portion of the outer housing 13, thus completing this attaching operation. At this time, each wire 60 is bent by the second plate portion 39 into the position of the axis C2 higher than the axis C1 as described above, and the portion of the wire 60 having the axis C2 is supported by the wire holding portion 41, and the portion of each wire 60, extending rearwardly from this wire holding portion 41, is bent to be directed toward the wire lead-out hole 40, and is led out of this wire lead-out hole 40.

When a hood portion 52 of the mating connector 50 is inserted between the outer housing 13 and the inner housing 11, the mating terminals 51 and 51 of the mating connector 50, while guided by the respective guide holes 20 and 20 of the front holder 19, are inserted into the respective terminal receiving chambers 16 and 16, and the elastic piece portions 27 and 27 of the outer housing 13 are retainingly engaged respectively with projections 53 and 53 (see FIG. 1) formed respectively on opposite side surfaces of the hood portion 52 of the mating connector 50, and the mating terminals 51 and 51 are electrically connected to the terminals 23 and 23, respectively.

As described above, in the connector 10, the rear cover 15, having the strain relief structure for holding the wires 60, is separate from the inner housing 11, and is fixed to the outer housing 13 in non-contacting relation to the inner housing 11 (that is, such that the rear cover 15 is disposed out of contact with the inner housing 11). Therefore, vibration of the wires 60 will not directly influence the inner housing 11 which receives the terminals 23 connected to the respective wires 60.

Furthermore, in the connector 10, the strain relief structure is formed within the rear cover 15, and includes the second plate portion 39 and the wire holding portion 41 which cooperate with each other to bend and hold the wires 60. Therefore, particularly when vibration of a small wavelength develops in each wire 60, this vibration is absorbed by the bent portion of the wire 60 bent by the second plate portion 39 and the wire holding portion 41 of the rear cover 15, and therefore is less liable to be transmitted to the terminal 23.

Furthermore, in the connector 10, the inner housing 11 is mounted in the outer housing 13 such that the inner housing 11 is urged forward by the springs 14 interposed between the inner and outer housings 11 and 13. Therefore, vibration, transmitted from the rear cover 15 to the outer housing 13, is absorbed by the springs 14 each serving as a damper. Particularly when vibration of a large wavelength develops in each wire 60, the rear cover 15 and the outer housing 13 are shaken, thereby greatly suppressing the influence of the vibration on the inner housing 11.

Furthermore, in the connector 10, the upper and lower covers 30 and 31 of the rear cover 15 are opened, and in this open condition the wires 60 are passed through the rear cover 15, and then the upper and lower covers 30 and 31 are closed. Therefore, the wires 60 can be easily bent by the second plate portion 39 and the wire holding portion 41, and can be easily led out of the rear cover 15.

The present invention is not limited to the above embodiment, and suitable modifications, improvements, etc., can be made. Furthermore, the material, shape, dimensions, numerical value, form, number, disposition, etc., of each of the constituent elements of the above embodiment are arbitrary, and are not limited in so far as the invention can be achieved.

For example, the second plate portion of the lower cover and the wire holding portion of the upper cover which jointly form the wire bending portion are not limited to the illustrated configurations, and there can be adopted a construction in which two plate portions for offsetting the axes of the adjacent portions of each wire from each other are formed on and project respectively from opposed portions of the upper and lower covers.

Furthermore, the number of the terminal-equipped wires is not limited to two (in the illustrated embodiment), but can be one or more than two, in which case also the invention can be achieved similarly to the above embodiment.

What is claimed is:

1. A connector comprising:

an inner housing receiving a terminal therein;

an outer housing which is separate from said inner housing, and is disposed around said inner housing to cover an outer peripheral surface of said inner housing;

a rear cover which is separate from said inner housing, and is fixed to a rear portion of said outer housing in non-contacting relation to said inner housing; and a wire which is connected to said terminal, and is led out of said inner housing through a rear end thereof, and passes through said rear cover to be led out of said rear cover; and a strain relief structure which holds said wire is provided at said rear cover;

wherein said connector further comprising a resilient urging member interposed between said inner housing and said outer housing; and said inner housing is mounted in said outer housing such that said inner housing is urged forward by said resilient urging member.

2. A connector according to claim 1, wherein said strain relief structure is formed within said rear cover, and includes a wire bending portion which bends and holds said wire.

3. The connector according to claim 1, wherein said inner housing has retaining portions which engage with retaining portions of said outer housing when said inner housing is inserted into said outer housing.

* * * * *